US005929821A

United States Patent [19]

Goldstein et al.

[11] Patent Number: 5,929,821

[45] Date of Patent: Jul. 27, 1999

[54] SLOT ANTENNA

[75] Inventors: Mark Lawrence Goldstein, Palm Bay; Eric Andrew Gyorko, Indialantic, both of Fla.; William A. Kerkhoff, Quincy, Ill.; Mark E. Riley, Hannibal, Mo.

[73] Assignee: Harris Corporation, Melbourne, Fla.

[21] Appl. No.: 09/054,879

[22] Filed: Apr. 3, 1998

[51] Int. Cl.[6] ..... H01Q 13/10; H01Q 13/12

[52] U.S. Cl. ..... 343/770; 343/768

[58] Field of Search ..... 343/770, 767, 343/768, 746, 790, 791; H01Q 13/10, 13/12

[56] References Cited

U.S. PATENT DOCUMENTS 2,971,193 2/1961 Siukola ..... 343/770
2,981,947 4/1961 Bazan ..... 343/770
4,763,130 8/1988 Weinstein ..... 343/770

*Primary Examiner*—Hoanganh Le
*Attorney, Agent, or Firm*—Tarolli, Sundheim, Covell Tummino & Szabo

[57] ABSTRACT

A slot antenna is disclosed for use in RF broadcasting. The antenna includes an elongated longitudinally extending hollow mast surrounding a longitudinal axis. An array of longitudinally spaced slots are formed in the mast for radiating electromagnetic energy therefrom. A coupler bar is associated with each slot. Each coupler bar is located within the mast between the ends of the associated slot for coupling electromagnetic energy from within the mast and developing with the slot a slot-coupler reactance. Tuning means is associated with each slot. Each tuning means is longitudinally spaced from the associated slot. Each tuning means extends inwardly from the mast toward the longitudinal axis for tuning the antenna to reduce the slot-coupler reactance.

20 Claims, 3 Drawing Sheets

SLOT ANTENNA

BACKGROUND AND FIELD OF THE INVENTION

The present invention relates to RF broadcasting antennas and, more particularly, to an improved slot antenna.

DESCRIPTION OF THE PRIOR ART

Slot antennas are known in the art. Typically, such antennas take the form of an elongated longitudinally extending hollow mast, constructed of metal, which surrounds a longitudinal axis. An array of longitudinally spaced slots are formed in the mast for radiating electromagnetic energy therefrom. A coupler bar is associated with each slot and is located within the mast between the ends of the associated slot and serves to couple electromagnetic energy from within the mast. Frequently, the mast is cylindrical in shape and serves as an outer conductor and coaxially surrounds a longitudinally extending inner conductor. In a waveguide construction there is no inner conductor.

Slot antennas are typically end fed such as that illustrated in FIG. 1 herein and will be described in greater detail below. These antennas may be horizontally, elliptically or circularly polarized. When used as television broadcasting antennas they typically are optimized to transmit signals for a particular television channel having a 6 MHz band width.

In the United States, the Federal Communications Commission (FCC) has established guidelines for broadcasting television signals. The established standard is known as the NTSC signal format. This is an analog signal format. The FCC has announced that digital television (DTV) will be forthcoming. During a transitionary period until approximately the year 2006, each television station will simultaneously broadcast an analog NTSC signal and a digital DTV signal.

It will be economical for a station broadcasting both NTSC and DTV signals that the signals be transmitted from a common antenna. This will save the station a significant amount for the cost of erecting a tower. A single tower with a common antenna for two or more channels will provide substantial savings.

It is desirable that a common antenna have a bandwidth sufficient to simultaneously transmit both NTSC and DTV signals. Preferably, the signals are adjacent channels, such as channels 21 and 22 (channel 21 extends from 512 MHz to 518 MHz whereas channel 22 extends from 518 MHz 524 MHz). The lower channel may be the digital (DTV) channel or the lower channel may be the NTSC channel.

A slotted antenna may be optimized to transmit two adjacent television channels, such as DTV and an NTSC.

It is known that such slotted antennas as discussed above are frequently tuned through trial and error experimentation with coupler bars of various sizes and configuration to control input impedance and radiation patterns. However, each coupler bar and its associated slot develop a slot-coupler reactance which causes a relatively high VSWR (voltage standing wave ratio) which adversely affects the operation of the antenna. The positioning of each coupler has been somewhat non-precise with the use of bolts for fastening means.

SUMMARY OF THE INVENTION

It is therefore an object of the present invention to provide an improved slot antenna employing tuning means associated with each slot in such a manner to improve the impedance performance and bandwidth while reducing inter bay VSWR.

It is a still further object of the present invention to provide such an improved slot antenna having means for precisely controlling the coupler bar position relative to the associated slot.

These and other objects will become more readily apparent from the discussion below.

In accordance with one aspect of the present invention an improved slot antenna is provided for use in RF broadcasting. The antenna includes an elongated longitudinally extending hollow mast that surrounds a longitudinal axis. An array of longitudinally spaced slots are formed in the mast for radiating electromagnetic energy therefrom. A coupler bar is associated with each slot with each coupler bar being located within the mast between the ends of the associated slot for coupling electromagnetic energy from within the mast and developing with the slot a slot-coupler reactance. A tuning means is associated with each slot. Each tuning means is longitudinally spaced from the associated slot. The tuning means extends inwardly from the mast toward the longitudinal axis for purposes of tuning the antenna to reduce the slot-coupler reactance.

In accordance with a more limited aspect of the present invention, locating means are provided for precisely controlling the positioning of the coupler means.

BRIEF DESCRIPTION OF THE DRAWINGS

The foregoing and other objects and advantages of the present invention will become more readily apparent from the following as taken in conjunction with the accompanying drawings wherein.

DESCRIPTION OF THE PREFERRED EMBODIMENT

Figure 1:
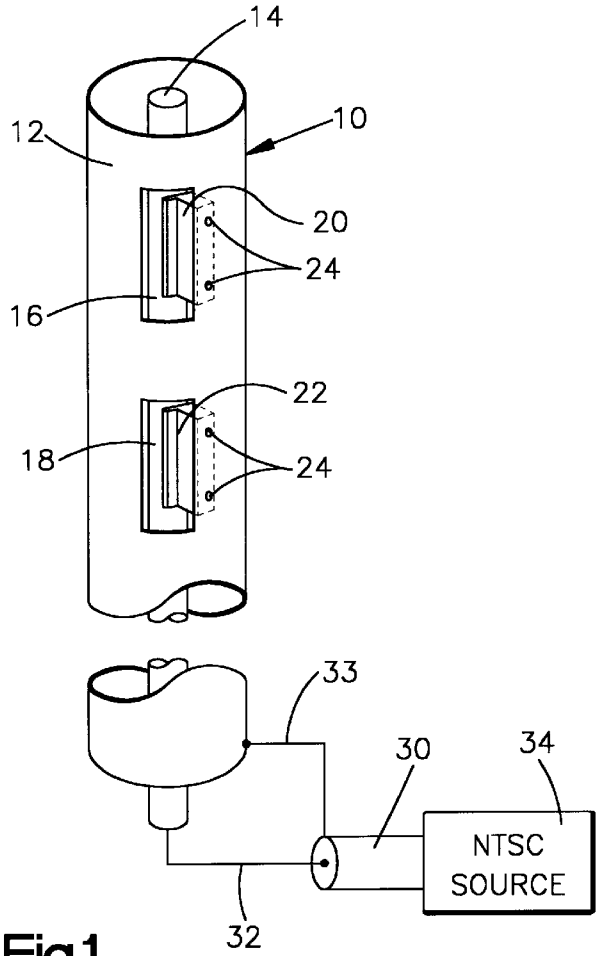
Fig.1 PRIOR ART
FIG. 1 is an elevational view of a typical prior art slotted antenna.

Reference is now made to FIG. 1 which illustrates a typical prior art, end-fed multi-bay slotted antenna 10. This antenna includes an elongated longitudinally extending cylindrical shaped hollow mast 12 serving as an outer conductor and which coaxially surrounds an inner conductor 14. Mast 12 may be constructed of a suitable material, such as steel or aluminum. An array of longitudinally spaced slots including slots 16 and 18 of two different bays are illustrated in FIG. 1. These slots, in a known manner, serve to radiate electromagnetic energy from the antenna. Each slot has associated therewith a coupler bar 20 or 22 suitably secured, as with bolts 24, to the mast so that each coupler bar is located within the hollow mast and extends over a portion of the length of the associated slot. The coupler bars assist in coupling the energy from within the mast so that the radiating field appears at the slot at which the coupler bar is associated. The coupler bars 20 and 22 may be conveniently constructed from such material as steel or aluminum. The slot antenna is energized from a coaxial cable wherein the center conductor 32 is connected to the inner conductor 14 of the slot antenna and the outer conductor 33 is electrically connected to the mast 12. In the past, such antennas have been energized from an NTSC source such as source 34 illustrated in FIG. 1.

It is known that the efficiency of operation of such an antenna varies with the positioning of the coupler bars 20 and 22. The alignment of a coupler bar and its associated slot may result in variations in efficiency. The positioning of coupler bar 20 at slot 16 and the fastening thereof by the associated bolts 24 may result in different energy coupling from that resulting from the positioning of the coupler bar 22 on the mast at the associated slot 18. When the coupler bar 20 is installed and fastened into place with the use of bolts 24 the tightening of the bolts tends to twist the coupler bar relative to the mast causing misalignment of the coupler bars. It is known that coupler bars also cause a development of a slot-coupler reactance resulting in a high VSWR (voltage standing wave ratio) which adversely affects the amount of power radiated at the associated slot.

Typically, the design of slotted antennas such as that shown in FIG. 1 involve trial and error experimentation with the coupler bars being of different sizes and different geometry in order to obtain variations in radiation patterns.

In accordance with the present invention, an improved slot antenna has been developed wherein the coupler bars may all be identical so as to simplify and standardize the design. This improved slot antenna may take the form as illustrated in FIG. 2 to be described below.

Figure 2:
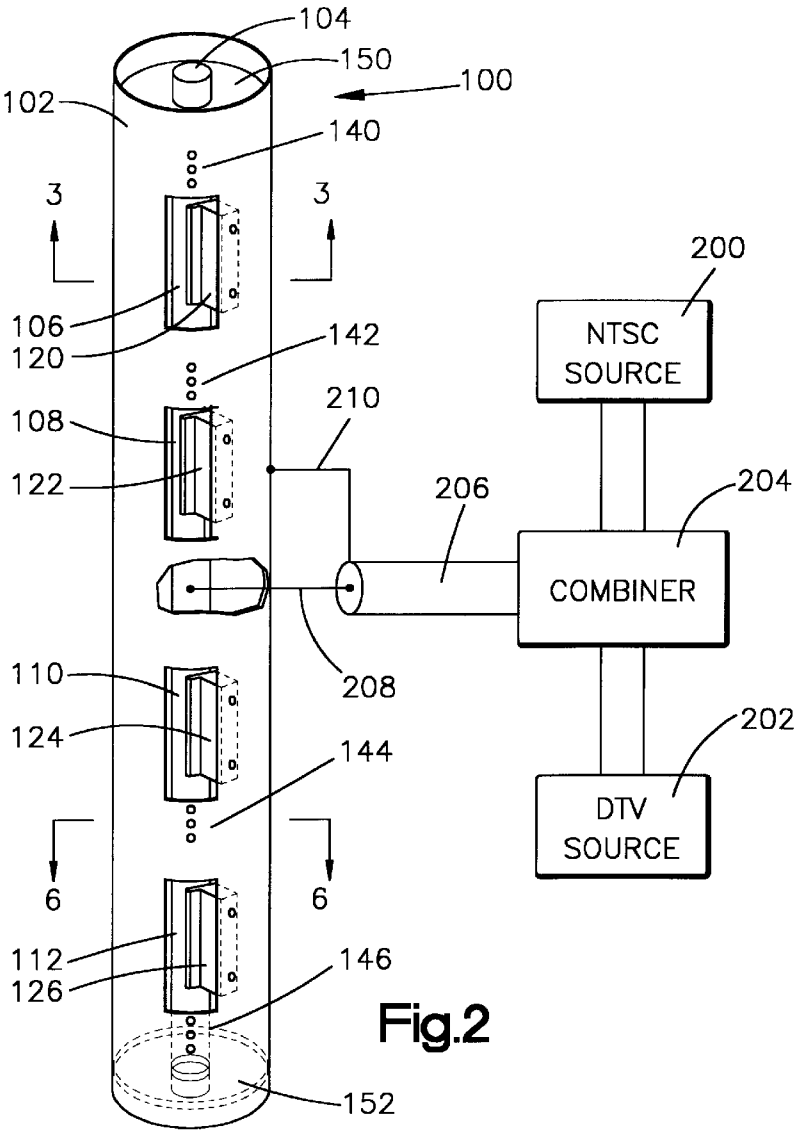
FIG. 2 is an elevational view of one embodiment of the present invention.

Reference is now made to FIG. 2 which illustrates a center fed, slot antenna 100 constructed in accordance with the present invention. This antenna takes the form of an elongated longitudinally extending hollow mast 102 of cylindrical cross section and serves as an outer conductor that coaxially surrounds an elongated inner conductor 104 that defines a longitudinal axis. The mast 102 may be constructed of metal, such as steel or aluminum. In the example illustrated herein there are four longitudinally spaced slots in the mast 102. These are divided into two upper slots 106 and 108 and two lower slots 110 and 112. Each slot is located within a bay. The four bays each have only one slot. Several slots may be located in each bay with the slots of each bay defining a coaxial array about the inner conductor 104.

Coupler bars 120, 122, 124, and 126 are respectively associated with slots 106, 108, 110, and 112. These coupler bars are located within the mast and are fastened thereto as with suitable bolts 128. A tuning means taking the form of probe assemblies 140, 142, 144, and 146 are respectively associated with slots 106, 108, 110, and 112.

Shorting plates 150 and 152 are located on the upper and lower ends of the antenna. Each shorting plate, such as plate 150, may take the form of a metal disk which electrically connects or shorts the inner conductor 104 to the outer conductor 102. Each shorting plate is located approximately ¾of a wavelength from the center of the adjacent slot in the mast.

The antenna is optimized for transmitting adjacent TV channels such as an NTSC channel and a DTV channel. Consequently, one input to the antenna is obtained from a NTSC source 200 and a second input is obtained from a DTV source 202. The outputs of these sources may be provided with coaxial cables to a suitable combiner 204 having an output coaxial cable 206. The inner conductor 208 of cable 206 extends through a suitable aperture in the wall of mast 102 and it is electrically connected to the inner conductor 104 of the slotted antenna. The outer conductor 210 of cable 206 is electrically connected to the mast 102.

Figure 3:
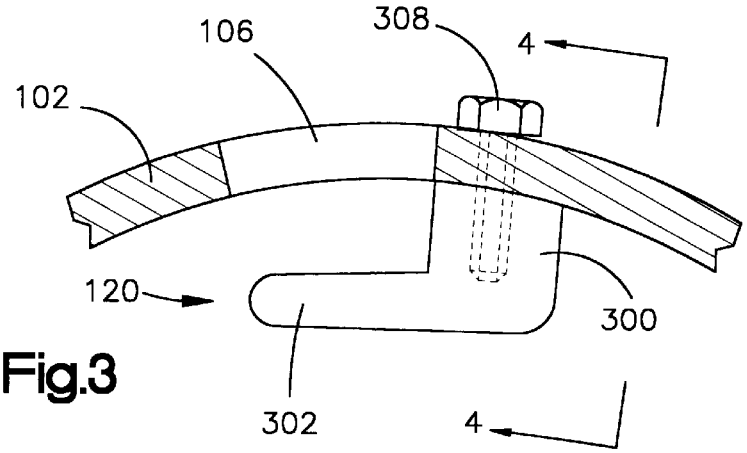
FIG. 3 is a view taken along line 3—3 looking in the direction of the arrows in FIG. 2.
Figure 4:
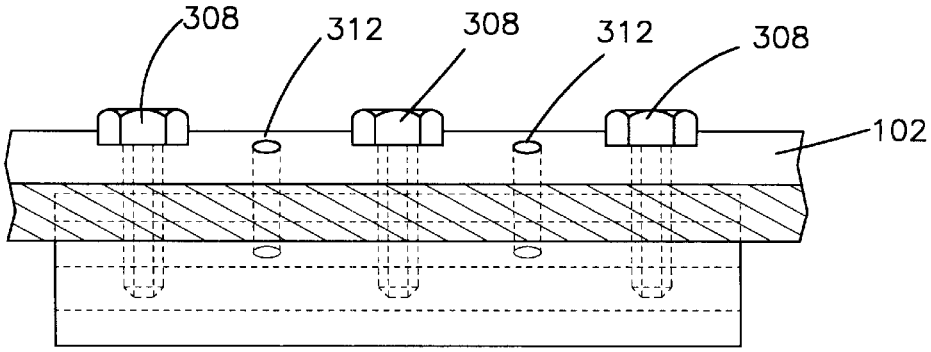
FIG. 4 is a view taken along line 4—4 of FIG. 3 looking in the direction of the arrows.
Figure 5:
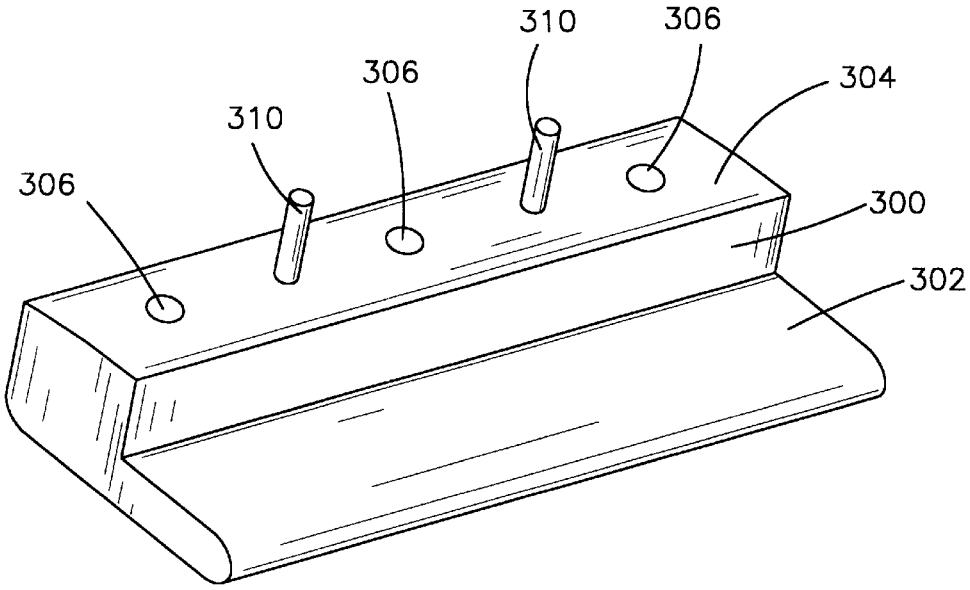
FIG. 5 is a perspective view showing a coupler bar in greater detail than that as illustrated in FIG. 4.

Reference is now made to FIGS. 3, 4, and 5 which illustrate the manner in which the coupler bars are mounted to the mast 102 in accordance with the present invention. The coupler bars, as best seen in FIGS. 3 and 5, are L shaped in configuration, including legs 300 and 302. Leg 300 has a mounting surface 304 which is adapted to be positioned against the inner surface of mast 102. This mounting surface 304 is provided with three threaded holes 306 to receive fastening bolts 308. These bolts 308 extend through three holes in the mast 102 and these mast holes are in registry with holes 306 in the coupler bar 300. As has been typical in prior art, these mast bolt holes are somewhat oversized and, in the absence of the guide pins to be discussed below, they result in twisting of the coupling bar relative to the mast as the bolts are tightened.

In accordance with the present invention, each coupler bar is provided with a pair of guide pins 310 which extend from the mounting surface 304. These guide pins are in registry with a pair of guide pin holes 312 located in the mast 102 between the mast bolt holes. These guide pins make a tight fit with the guide pin holes in mast 102 during assembly. This guide pin arrangement guides the coupler bar in place relative to the mast so that when the bolts 308 are tightened the coupler bar will not twist relative to the mast to cause misalignment and variations in tuning of the antenna. The mast may be of a thickness on the order of ¼". The guide pins 310 extend upwardly from the mounting surface 304 by a distance somewhat less than the thickness of the mast wall and, for example, may extend upwardly from the mounting surface 304 by a distance on the order of 3⁄16".

Figure 6:
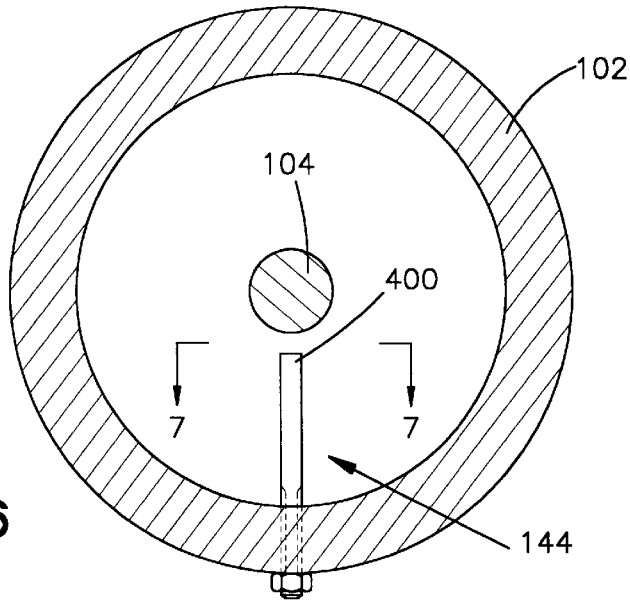
FIG. 6 is a cross-sectional view taken along line 6—6 looking in the direction of the arrows in FIG. 2.
Figure 7:
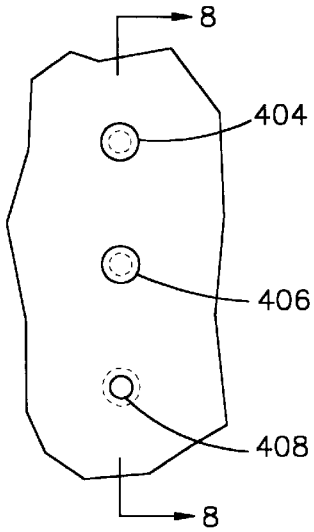
FIG. 7 is a view taken along line 7—7 looking in the direction of the arrows in FIG. 6.
Figure 8:
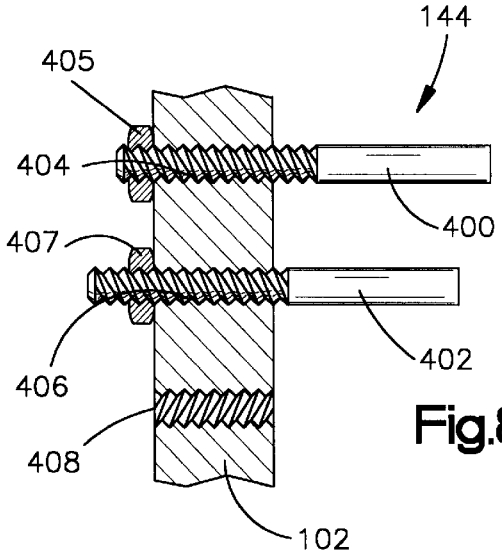
FIG. 8 is a view taken generally along line 8—8 looking in the direction of the arrows in FIG. 8.

Reference is now made to FIGS. 6, 7 and 8 which illustrate the tuning means 144 in greater detail than that as illustrated in FIG. 2. It is to be understood that whereas only the tuning means 144 is described in detail relative FIGS. 6, 7 and 8 the tuning means 140 associated with slot 106, tuning means 142 associated with slot 108 and tuning means 146 associated with slot 112 are all constructed and positioned in the same manner as is described below.

The tuning means 144 is longitudinally spaced from slot 110. While tuning means 144 is located intermediate slots 110 and 112 it is to be noted that it is located closer to the associated slot 110 than it is to slot 112.

As best shown in FIGS. 6, 7 and 8, the tuning means takes the form of rod like probes which extend radially inward from the inner wall of mast 102 toward the inner conductor 104. As illustrated in FIG. 8 only two probes, 400 and 402, are shown extending inwardly from mast 102 toward the inner conductor 104. Whereas only two probes are shown extending inwardly from two threaded apertures 404 and 406 additional probes may also extend inwardly from other threaded apertures, such as aperture 408. Also, the probes 400 and 402 may be of the same or different lengths. If they are of the same length each may be threaded by a different distance into the associated threaded apertures 404 and 406 in order to adjust the amount by which each probe extends into the interior of the mast toward inner conductor 104. The probes are then locked in place with lock nuts 405 and 407. The probes are adjusted to tune the antenna to compensate for the slot-coupler reactance of each coupler bar associated with the same slot in order to reduce the reactance and thereby reduce the associated VSWR.

Alternatively, the tuning means may take forms other than rod like probes extending inwardly toward inner conductor 104 from the interior of mast 102. Such other forms may include, for example, an annular flange which extends from the inner wall of mast 102 radially inward toward inner conductor 104 with the flange being located so as to be longitudinally spaced from an associated slot in the same manner as the probes discussed above.

Tuning of the antenna with tuning means such as the probes discussed above provides control or the power radiated from the various slots. The power made available to each slot can be controlled as a fixed percentage of the power available to that slot. For example, the antenna of FIG. 2 may be tuned to radiate a fixed percentage of the power available to slot 108. This may be the same fixed percentage of the power available to slot 106 (noting however that the amount of power available to slot 106 will be less than that to slot 108). This tuning may also be adjusted for slots 110 and 112 in the same manner.

The antenna is preferably optimized so that it may be used for transmitting two adjacent television channels each being 6 MHz wide. One channel may be a DTV channel and the other channel may be an NTSC channel. Either the lower channel or the upper channel may be the DTV channel, as desired.

Figure 9:
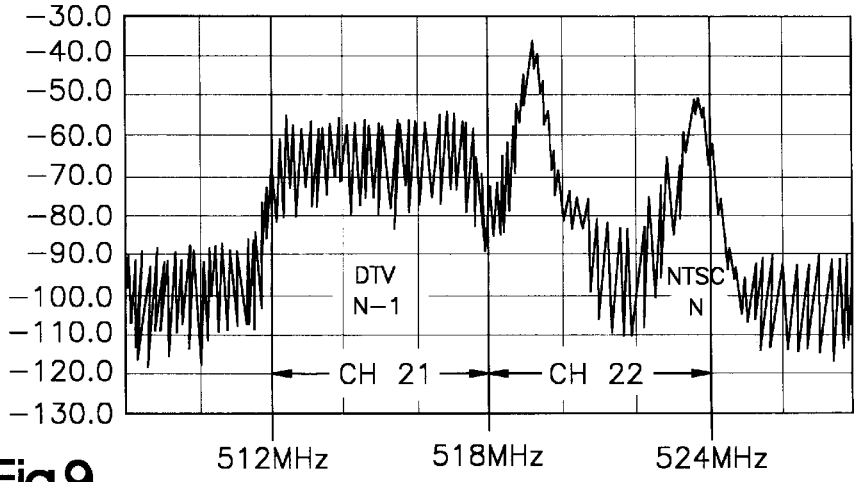
FIG. 9 is a graphical illustration of amplitude with respect to frequency showing the operation of adjacent NTSC and DTV channels.

Reference is now made to FIG. 9 which shows a waveform of amplitude with respect to frequency for adjacent NTSC and DTV channels with the DTV channel being of lower frequencies than that of the NTSC channel. This is one illustration of operation, it being understood that the DTV channel may be of the higher frequencies.

From the above description of the invention, those skilled in the art will perceive improvements, changes and modifications in the invention. Such improvements, changes and modifications within the skill of the art are intended to be covered by the appended claims.

Having described the invention, it is now claimed:

1. A slot antenna for use in RF broadcasting, comprising:

a longitudinal axis;

an elongated longitudinally extending hollow mast surrounding said longitudinal axis;

an array of longitudinally spaced slots formed in said mast for radiating electromagnetic energy therefrom;

coupler means associated with each said slot, each said coupler means being located within said mast between the ends of the associated said slot for coupling electromagnetic energy from within said mast and developing with said slot a slot-coupler reactance; and, tuning means associated with each said slot, each said tuning means being longitudinally spaced from the associated said slot, each said tuning means extending inwardly from said mast toward said longitudinal axis for tuning said antenna to reduce the slot-coupler reactance.

2. A slot antenna as set forth in claim 1 wherein said tuning means includes adjustable probe means for adjustably varying the extent it extends toward said longitudinal axis.

3. A slot antenna as set forth in claim 2 wherein each said tuning means includes a plurality of probe rods.

4. A slot antenna as set forth in claim 3 wherein each said rod is an elongated rod which is threaded about one end and wherein said mast has a threaded aperture associated with each said rod for threadably receiving the threaded end of the associated said rod.

5. A slot antenna as set forth in claim 4 wherein each said rod of each said tuning means is of a different length.

6. A slot antenna as set forth in claim 1 wherein each said coupler means includes a coupler bar having a plurality of guide pins extending therefrom and wherein said mast has a guide pin aperture associated with each said guide pin to assist in properly positioning each said coupler bar in place against said mast.

7. A slot antenna as set forth in claim 6 wherein each said coupler bar is L shaped having a first leg which carries said guide pins and a second leg which extends essentially perpendicular to said first leg and is positioned within said mast over a portion of the length of a said slot.

8. A slot antenna as set forth in claim 1 wherein said antenna includes an elongated inner conductor defining said longitudinal axis.

9. A slot antenna as set forth in claim 8 wherein said mast is an elongated hollow cylinder which coaxially surrounds said inner conductor.

10. A slot antenna as set forth in claim 9 wherein said tuning means includes adjustable probe means for adjustably varying the extent it extends toward said longitudinal axis.

11. A slot antenna as set forth in claim 10 wherein each said tuning means includes a plurality of probe rods.

12. A slot antenna as set forth in claim 11 wherein each said rod is an elongated rod which is threaded about one end and wherein said mast has a threaded aperture associated with each said rod for threadably receiving the threaded end of the associated said rod.

13. A slot antenna as set forth in claim 12 wherein each said rod of each said tuning means is of a different length.

14. A slot antenna as set forth in claim 9 wherein each said coupler means includes a coupler bar having a plurality of guide pins extending therefrom and wherein said mast has a guide pin aperture associated with each said guide pin to assist in properly positioning each said coupler bar in place against said mast.

15. A slot antenna as set forth in claim 14 wherein each said coupler bar is L shaped having a first leg which carries said guide pins and a second leg which extends essentially perpendicular to said first leg and is positioned within said mast over a portion of the length of a said slot.

16. A slot antenna as set forth in claim 15 wherein said coupler bars are identical in size and configuration.

17. A slot antenna for use in RF broadcasting comprising:

an elongated longitudinally extending hollow conductive mast having a longitudinal axis, an elongated conductive element extending longitudinally within the mast along the axis, and a plurality of longitudinally spaced slots formed in the mast;

connection means adapted to be connected to a source of RF signals for applying the RF signals to the mast and conductive element;

an RF signal coupler associated with each of the slots, each of the couplers being mounted by fastening devices to the mast, separate couplers being located within the mast adjacent each separate slot for coupling RF electromagnetic energy from within the mast for the radiation the energy from the associated slot, at least one of the couplers having guides that match guides on the mast for controlling the positioning of the coupler while being secured to the mast by the fastening device.

18. A slot antenna as defined in claim 17 wherein the fastening devices are threaded bolts and the guides are pin and hole arrangements.

19. A method of mounting a coupler within a slot antenna that includes an elongated longitudinally extending hollow conductive mast having a longitudinal axis, a plurality of longitudinally spaced slots formed in the mast, a RF signal coupler associated with each of the slots adapted to be mounted to the mast within the mast and adjacent respective slots by fastening devices, the method comprising:

providing matching guides located on a coupler and located within the mast adjacent the respective slot to provide a guide mechanism for accurately positioning the coupler at a desired preset location relative to the slot;

inserting the coupler within the mast using the guide to accurately position the coupler at its preset location adjacent its respective slot; and securing the coupler to the mast with the fastening device while the guides control the placement of the coupler at the preset location relative to the slot.

20. A method of tuning a RF broadcast slot antenna to control slot-coupler reactance, which antenna includes an elongated longitudinally extending hollow conductive outer mast having a longitudinal axis, an elongated conductive element extending longitudinally within the mast along the axis, an elongated conductive element extending longitudinally within the mast along the axis, connection means adapted to be connected to a source of RF signals for applying the RF signals to the mast and conductive element, a plurality of longitudinally spaced slots formed in the mast, a separate RF signal coupler associated with each of the slots adapted to be mounted to the mast thin the mast and adjacent to a respective slot for radiating RF energy from the slot, the method of tuning comprising:

providing an adjustable element secured adjacent a slot that extends from the mast into the hollow portion of the mast toward the inner conductor; and adjusting the amount to which the element extends into the mast to control the slot-coupler reactance.

* * * * *